US005265455A

United States Patent [19]

Grimmer

[11] Patent Number: 5,265,455

[45] Date of Patent: Nov. 30, 1993

[54] CYLINDER LOCK AND KEY SET WITH REVERSIBLE KEY

[75] Inventor: Larry R. Grimmer, Sussex, Wis.

[73] Assignee: Briggs & Stratton Corp., Wauwatosa, Wis.

[21] Appl. No.: 909,169

[22] Filed: Jul. 6, 1992

[51] Int. Cl.[5] ..... E05B 29/04

[52] U.S. Cl. ..... 70/492; 70/375; 70/377; 70/406; 70/409

[58] Field of Search ..... 70/358, 492, 377, 405–407, 70/409, 495, 375, 376, 462

[56] References Cited

U.S. PATENT DOCUMENTS

| | | | |
|---|---|---|---|
| 3,367,156 | 2/1968 | Johnstone | 70/377 |
| 3,969,915 | 7/1976 | Droske | 70/377 X |
| 4,357,815 | 11/1982 | Kleefeldt et al. | 70/377 X |
| 5,134,871 | 8/1992 | Makino et al. | 70/492 |

FOREIGN PATENT DOCUMENTS

| | | | |
|---|---|---|---|
| 1031541 | 6/1953 | France | 70/377 |
| 2064637 | 6/1981 | United Kingdom | 70/492 |

*Primary Examiner*—Lloyd A. Gall

*Attorney, Agent, or Firm*—Andrus, Sceales, Starke & Sawall

[57] ABSTRACT

A reversible double-bitted key is reconfigured to permit a cylinder lock and key set to fit in the standard architecture of certain American automobiles. Preferably, the maximum required diameter of the cylinder is maintained under 13 millimeters, permitting the cylinder to be placed in standard instrument panel architecture for many American made vehicles. The minimum width of the key is maintained at approximately 4 millimeters, assuring that the key can withstand the torque requirements of the lock systems. This permits a single key to be used in both the primary and secondary locks. The tumbler is configured such that the minimum distance between the outer edge of the key window in the tumbler and the outer perimeter of the tumbler is greater than the thickness of the tumbler, further assuring that the lock can withstand repeated use without fatigue failure.

12 Claims, 2 Drawing Sheets

CYLINDER LOCK AND KEY SET WITH REVERSIBLE KEY

BACKGROUND OF THE INVENTION

1. Field of the Invention

This invention is generally related to cylinder lock and key sets of the type used in automotive primary and secondary lock systems and is specifically directed to a compact cylinder lock and key set including a reversible double-bitted key.

2. Description of the Prior Art

Cylinder lock and key sets for automotive use are well known. Typically, the cylinder is housed in a cylindrical opening provided in a housing. The housing is mounted in a cavity in the implement or apparatus to be controlled by the lock. For example, it is typical to provide a cylindrical lock and key set for the ignition of the automobile on the steering column, to provide an instrument panel lock such as a storage compartment or glove compartment, door locks and rear deck locks. The cylinder typically includes an axial key way adapted for receiving a bitted or notched key which engages tumblers housed in the cylinder. The tumblers are normally biased radially outwardly from the cylinder into engagement with the housing to prohibit rotation of the cylinder for locking the lock. When a properly bitted key is inserted in the key way of the cylinder and engages like encoded tumblers, the tumblers are withdrawn from the housing into the cylinder, permitting rotation of the cylinder to unlock the apparatus or to activate a system such as an ignition system.

Over the years, it has become more desirable to utilize single keys for access to both the primary (ignition) and secondary (instrument panel, door and deck) locks of a vehicle. It has also become desirable to utilize reversible keys so that the key may be readily inserted in the key way irrespective of its orientation.

The prior art reversible key systems required enlarged cavities for housing the cylinder lock sets. For example, reversible key-type secondary locks on many American cars require housing cavities with a minimum diameter of over 15 millimeters. This has created some problems when making secondary locks, particularly for instrument panel adaptation.

By way of example, the cavities provided in instrument panel systems for automobiles typically made by General Motors have maximum cylinder capacities of under 13 millimeters. In order to adopt reversible double-bitted keys for such locks, it is either required that the cylinder and key be reconfigured to fit into the available architecture (13 millimeters or less in diameter) or that the vehicle manufacturer adopt a larger cavity. In order for a vehicle manufacturer to adopt larger cavities, it is required that the entire instrument panel or other lock actuated mechanism be retooled, generating an expense in the tens of millions of dollars.

Therefore, it is desirable to provide a cylinder lock and key set having a reversible double-bitted key which is configured to fit into the standard architecture. None of the prior art double-bitted reversible lock and key sets meets this objective. This is primarily because the key width is dictated by torque requirements, and the key width caused an outward progression of the size of the key way, the cylinder, the tumbler window and ultimately the cavity for accepting the cylinder system. Therefore, there remains a need for a reconfigured double-bitted reversible lock and key set which is adapted for accommodating the standard architecture of many current vehicle systems.

SUMMARY OF THE INVENTION

The cylinder lock and key set of the subject invention is adapted for use in standard architecture automotive systems. Specifically, in the preferred embodiment of the invention the cylinder has a required outer diameter of less than 13 millimeters, making it readily adaptable for use in instrument panel locks and other secondary locks without requiring retooling of the lock actuated system and of the cavity for housing the lock.

In the preferred form of the invention, the cylinder lock and key set is adapted to be disposed in a body, with the cylinder in rotating relationship relative to the body. A set of radially movable tumblers are mounted within the cylinder and are adapted for selective movement into and out of engagement with the body for selectively locking the cylinder against rotation relative to the body. The cylinder includes a key way adapted for receiving a key for slidably engaging the tumblers and moving the tumblers out of engagement with the body for permitting rotation of the cylinder.

In the preferred form of the invention, the cylinder is at a predetermined outer diameter, preferably less than 13 millimeters, and includes an axial key way for a key having a preferable maximum width of 8 millimeters. A radially movable tumbler is of a length and a width each of which is less than the outer diameter of the cylinder and of a predetermined thickness, of approximately 1 millimeter. The tumbler is housed in the cylinder in an orientation orthogonal to the axis of the cylinder and in intersecting relationship with the key way. A window is provided in the tumbler for receiving the key when it is inserted in a key way of the cylinder. The window includes outer end edges which are encoded to receive specific notches on the key for removing the tumbler from the engagement with the body and pull it into the cylinder, for permitting rotation of the lock.

In the preferred embodiment of the invention, the outer end edge of the window is spaced inwardly from the outer perimeter edge of the tumbler such that the minimum distance between the end edge of the window and the adjacent perimeter edge of the tumbler is greater than the thickness of the tumbler. This assures that the tumbler is of sufficient strength to provide a specific number of repeated uses without the key. In its preferred form, the minimum distance between the window and the perimeter edge of the tumbler is between 1.2 and 1.5 times the thickness of the tumbler.

The key is adapted to include up to four stepped notches, each of a depth of approximately 0.6 millimeters wherein the outer widest portion of the key blade is 8 millimeters while the minimum distance between opposing notches is never less than 4 millimeters, providing a key that can continually accept the torque requirements for turning the cylinder in the housing, whether the cylinder is incorporated in a primary (ignition) lock or a secondary (instrument panel, door and/or deck) lock.

It is, therefore, an object and feature of the subject invention to provide an improved cylinder lock and key set with a double-bitted reversible key for use in standard architecture of American automotive manufacturers.

It is yet another object and feature of the subject invention to provide a cylinder lock and key set having a common key adapted for use in both primary and secondary locks.

It is yet another object and feature of the subject invention to provide an improved reversible double-bitted cylinder lock and key set having a maximum key width of 8 millimeters which is adapted for accepting the torque required to turn the cylinder in the cavity without fatigue failure.

Other objects and features of the invention will be readily apparent from the accompanying drawings and description.

BRIEF DESCRIPTION OF THE DRAWINGS

The drawings illustrate the best mode presently contemplated of carrying out the invention.

DETAILED DESCRIPTION OF THE PREFERRED EMBODIMENT

Figure 1:
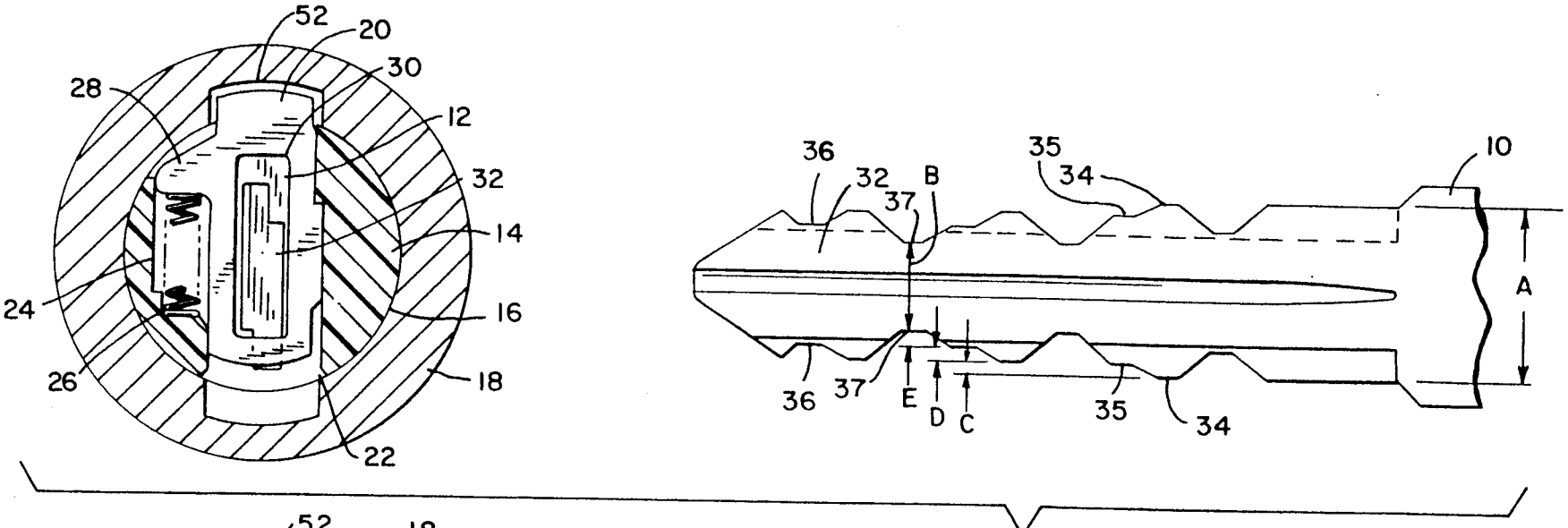
FIG. 1 is an exploded view of a lock and key set in accordance with the subject invention.

As shown in FIG. 1, the key 10 of the subject invention is adapted to be received in the key way 12 of a rotating cylinder 14. The rotating cylinder 14 is rotatably housed in the cavity 16 of a housing 18. A tumbler 20 is disposed in the interior cavity 22 of the cylinder and is mounted for radial movement between the extended position shown in FIG. 1 and the retracted position shown in FIG. 2. Typically, a plurality of tumblers are located along the key way. A spring cavity 24 is provided in the cylinder for a compression spring 26 which is in engagement with the ear 28 provided on the tumbler 24 for normally biasing the tumbler 20 into the extended position shown in FIG. 1.

The tumbler includes a window 30 adapted for receiving the key blade 32. In the preferred embodiment, the maximum width A (FIG. 1) of the key is approximately 8 millimeters. The key is adapted for including a plurality of stepped notches 34, 35, 36 and 37. In a double-bitted reversible key, the notches are positioned on opposite side edges of the key and are in alignment with each other, as shown in FIG. 1. It is important that the narrowest width B of the key blade be sufficiently wide enough to withstand the torque requirements of the key as the key is utilized to turn the cylinder 14 in the cavity 16. In the preferred embodiment, the key width B is set at a minimum of 4 millimeters.

The step distances C through E are each required to be a minimum of 0.6 millimeters in order to assure accuracy of the tumbler and notch engagement to assure that only properly bitted keys can actuate the lock system.

In the preferred embodiment the actual notch step distances C, D and E are approximately 0.64 millimeters. By utilizing a maximum key width of 8 millimeters and a notch step of approximately 0.64 millimeters, the double-bitted key of FIG. 1 maintains a minimum width B of 4 millimeters, meeting the torque requirements for the key utilizing standard key materials such as aluminum and the like.

Figure 3:
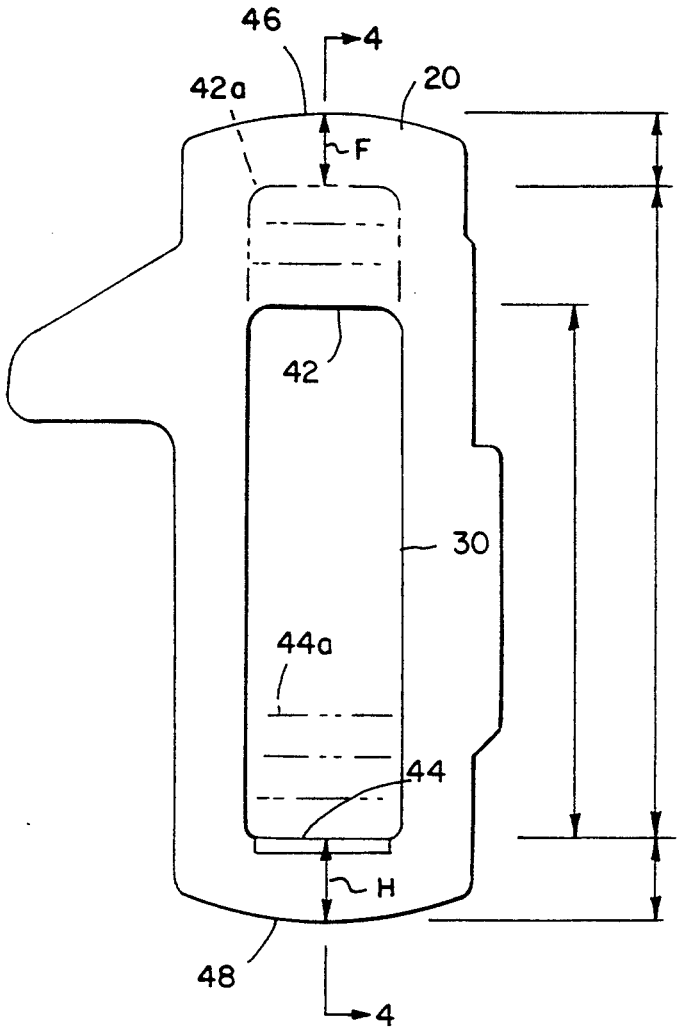
FIG. 3 is an enlarged elevation view of a tumbler for use in accordance with the subject invention.
Figure 4:
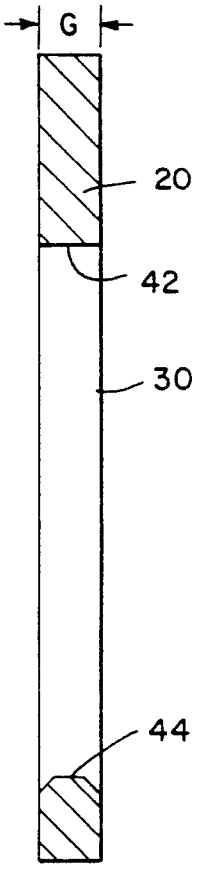
FIG. 4 is a section view taken along the line 4—4 of FIG. 3.

With specific reference to FIG. 3, it will be noted that the window 30 in the tumbler 20 has an upper outer edge 42 and a lower outer edge 44. Depending on which notch in the key 10 is adapted for engaging the specific tumbler 20 in the cylinder, the window 30 will move to an uppermost region with the upper edge 42 at the position of 42*a* as shown in phantom in FIG. 3 with the lowermost edge 44 moving to the position of 44*a*, also shown in phantom, in FIG. 3. In order for the lock to properly work, it is important that the minimum distance between the top most position of the upper edge 42*a* of the window and the upper perimeter edge 46 of the tumbler be greater than the width of thickness G (FIG. 4) of the tumbler. Likewise, it is important that the minimum distance H between the lowermost edge 44 of the window and the lower outer perimeter 48 of the tumbler be greater than the thickness G of the tumbler. This assures that the tumbler 20 is of sufficient strength to operate repeatedly without fatigue failure. In the preferred embodiment, the thickness G is approximately 1 millimeter.

Figure 2:
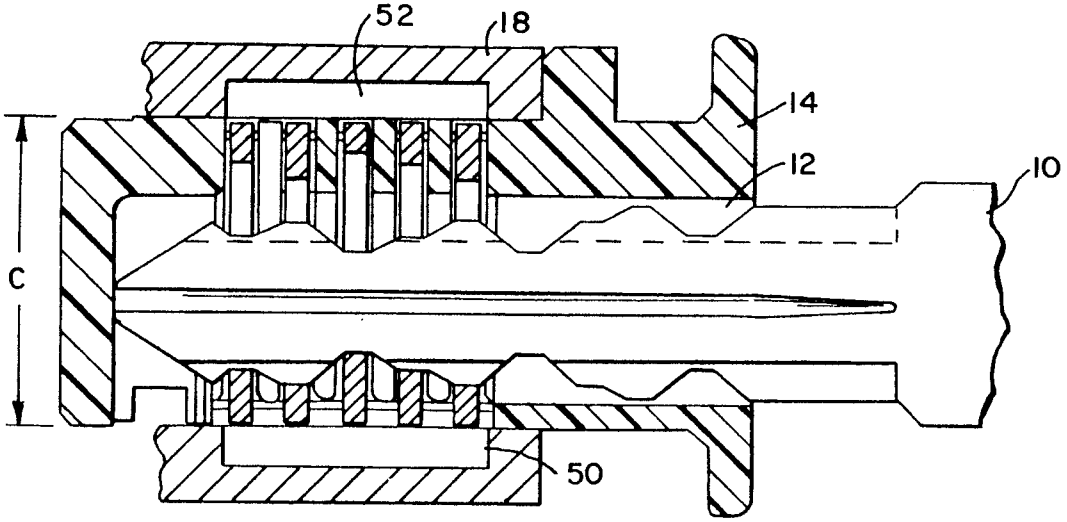
FIG. 2 is an elongated, axial section view of the cylinder showing the cylinder, key way, tumblers and key in assembly.

With specific reference to FIG. 2, it will be noted that when the key 10 is inserted in the slot, the various notches 34–37 on the key will engage respective tumblers 20 to pull the tumbler down to the retracted position shown. By locating the windows in accordance with the notch locations on the key, the tumblers are fully retracted into the cylinder, permitting rotation of the cylinder 14 relative to the housing 18.

It will be noted that as the key enters the key way 12, and the outermost portion of the key engages the tumblers, some of the tumblers will move beyond the lower outer portion of the cylinder and into a clearance cavity 50 provided in the housing. However, once the key is properly seated, the tumblers 20 are completely withdrawn from the housing and into the cylinder, permitting free rotation of the cylinder 14. When the key is removed, the tumblers 20 are then spring biased outwardly from the cylinder into the locking chamber 52 provided in the housing, as is specifically shown in FIG. 1. By utilizing an 8 millimeter maximum width key and a tumbler with the window as configured as shown in the window 30 of FIG. 3, and assuring that the minimum distances F and H are greater than the thickness G of the tumbler, the entire assembly can occupy a cylinder having an outer diameter J (FIG. 2) which fits in the standard architecture of many American made automobiles. This permits the reversible double-bitted single key lock set of the subject invention to be utilized in many American cars without requiring retooling of the systems to be actuated or controlled by the lock set. This greatly reduces the cost in change over by pushing all of the new tooling costs into a lock and key set rather than into the automotive systems.

In the preferred embodiment, the maximum diameter J of the cylinder 14 is less than 13 millimeters, preferably approximately 12.8 millimeters. Utilizing the configuration of the subject invention, this diameter can accommodate a functional double-bitted reversible key set.

While certain features and embodiments of the invention have been described in detail herein, it will be readily understood that the invention includes all modifications and enhancements within the scope and spirit of the appended claims.

I claim:

1. In a cylinder lock and key set having a body for housing a rotating cylinder, radially movable tumblers mounted within the cylinder and adapted for selective movement into and out of engagement with the body for selectively locking the cylinder against rotation relative thereto and a key adapted to be slidably received in the cylinder having a plurality of notches for engaging the tumblers and moving same out of engagement with the body for permitting rotation of the cylinder, an improvement comprising:

a. the cylinder of a predetermined outer diameter and having an axial key way, said key way having an open outer end for receiving said key and a closed inner end defined by a stop formed by said cylinder for limiting axial movement of said key into said cylinder;

b. the radially movable tumblers of a length and a width, each of which is less than the outer diameter of the cylinder, and a predetermined thickness, the tumblers housed in the cylinder in an orientation orthogonal to the axis of the cylinder and in intercepting relationship with the key way;

c. a window in each tumbler for receiving the key when inserted in the key way of the cylinder, the window having outer end edges spaced inwardly from the outer perimeter of said each tumbler such that the minimum distance between the end edge of the window and the adjacent perimeter edge of said each tumbler is within a range of between 1.2 and 1.5 times the thickness of said each tumbler; and d. the key comprises a double bitted, reversible key adapted to be slidably received in the key way of the cylinder, the key including a blade having a tip end engagable with said stop upon insertion of said key in said key way to limit axial movement of said key into said key way, and the key further including opposite outer edges including like notches for engaging an end edge of said each tumbler window for moving said each tumbler relative to the cylinder and the body, wherein the minimum distance between like notches on the opposite edges of the key is greater than 4 millimeters.

2. The improvement of claim 1, wherein said each tumbler is approximately 1 millimeter in thickness and the minimum distance is between 1.24 and 1.50 millimeters.

3. The improvement of claim 1, wherein the outer diameter of the cylinder is less than 13 millimeters.

4. The improvement of claim 1, wherein the key includes up to four stepped notches each having a depth within a range of 0.6 to 0.7 millimeters.

5. The improvement of claim 4, wherein each notch has a depth of approximately 0.6 millimeters.

6. The improvement of claim 1, wherein the distance between the opposite edges of the key is approximately 8 millimeters.

7. The improvement of claim 1, wherein the body includes a pair of diametrically opposed tumbler receptive channels, whereby said each tumbler is normally disposed in one of said channels for locking the cylinder against rotation, and wherein said each tumbler is adapted to be moved by the key as it is slidably inserted in the key way first into the other of said channels for providing clearance for the widest part of the key and then into engagement with one of said notches whereby said each tumbler is contained within the cylinder for permitting rotation of the cylinder.

8. The improvement of claim 1, including biasing means housed in the cylinder and in engagement with said each tumbler for normally biasing said each tumbler radially outwardly from the cylinder and toward the body.

9. In a cylinder lock and key set having a body for housing a rotating cylinder, radially movable tumblers mounted within the cylinder and adapted for selective movement into and out of engagement with the body for selectively locking the cylinder against rotation relative thereto and a key adapted to be slidably received in the cylinder having a plurality of notches for engaging the tumblers and moving same out of engagement with the body for permitting rotation of the cylinder, an improvement comprising:

a. the cylinder of an outer diameter of less than 13 millimeters and having an axial key way adapted for receiving a key having a maximum width of approximately 8 millimeters, said key way having an open outer end for receiving said key and a closed inner end defined by a stop formed by said cylinder for limiting axial movement of said key into said cylinder;

b. the radially movable tumblers of a length and a width, each of which is less than the outer diameter of the cylinder, and of a thickness of approximately 1 millimeter, the tumblers housed in the cylinder in an orientation orthogonal to the axis of the cylinder and in intercepting relationship with the key way; and c. a window in said each tumbler for receiving the key when inserted in the key way of the cylinder, the window having outer end edges spaced inwardly from the adjacent outer perimeter edge of said each tumbler such that the minimum distance between the end edge of the window and the adjacent perimeter edge of said each tumbler is within a range of between 1.2 and 1.5 times the thickness of said each tumbler; and d. the key comprises a double bitted, reversible key adapted to be slidably received in the key way of the cylinder, the key including a blade having a tip end engagable with said stop upon insertion of said key in said key way to limit axial movement of said key into said key way, and the key further including opposite outer edges including like notches for engaging an end edge of said each tumbler window for moving said each tumbler relative to the cylinder and the body, wherein the minimum distance between like notches on the opposite edges of the key is greater than 4 millimeters.

10. The improvement of claim 9, wherein the minimum distance is between 1.24 and 1.50 millimeters.

11. The improvement of claim 9, wherein the key includes up to four stepped notches each having a depth within a range of 0.6 to 0.7 millimeters.

12. The improvement of claim 11, wherein each notch has a depth of approximately 0.6 millimeters.

* * * * *